US008544535B2

(12) United States Patent
Cote et al.

(10) Patent No.: US 8,544,535 B2
(45) Date of Patent: Oct. 1, 2013

(54) INTEGRATED WELLHEAD ASSEMBLY

(75) Inventors: Sheldon Cote, Missouri, TX (US); Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 694 days.

(21) Appl. No.: 12/705,484

(22) Filed: Feb. 12, 2010

(65) Prior Publication Data

US 2011/0198072 A1 Aug. 18, 2011

(51) Int. Cl.
*E21B 33/04* (2006.01)
*E21B 33/03* (2006.01)

(52) U.S. Cl.
USPC ..... 166/75.13; 166/368

(58) Field of Classification Search
USPC ..... 166/75.11, 75.13, 68.5, 78.1, 368, 166/242.5
See application file for complete search history.

(56) References Cited

U.S. PATENT DOCUMENTS

| | | | | |
|---|---|---|---|---|
| 2,148,327 | A | 2/1939 | Roger et al. | |
| 2,162,179 | A | 6/1939 | Mueller | |
| 3,163,430 | A * | 12/1964 | Normand | 166/84.1 |
| 5,743,332 | A | 4/1998 | Lam et al. | |
| 6,095,241 | A | 8/2000 | Bland et al. | |
| 6,457,530 | B1 * | 10/2002 | Lam et al. | 166/368 |
| 6,557,643 | B1 * | 5/2003 | Hall et al. | 166/382 |
| 6,595,278 | B1 * | 7/2003 | Lam et al. | 166/75.14 |
| 2008/0277120 | A1 * | 11/2008 | Hickie | 166/308.1 |
| 2011/0198074 | A1 * | 8/2011 | McGuire et al. | 166/88.1 |
| 2011/0266005 | A1 * | 11/2011 | Hult et al. | 166/378 |

FOREIGN PATENT DOCUMENTS

| | | |
|---|---|---|
| CA | 2098324 | 2/2001 |
| CA | 2349988 | 10/2001 |
| CA | 2311036 | 12/2001 |

OTHER PUBLICATIONS

International Search Report for PCT Application No. PCT/US2010/061632 dated Oct. 6, 2011, 12 pgs.

* cited by examiner

*Primary Examiner* — Daniel P Stephenson
(74) *Attorney, Agent, or Firm* — Fletcher Yoder, P.C.

(57) ABSTRACT

An integrated wellhead assembly is provided to enable free flow production and artificial lift production from a well without requiring removal and/or reconfiguration of the wellhead assembly. The wellhead assembly includes an upper portion and a lower portion forming an integrated assembly. The upper portion includes a flow tee and at least one set of rams. The lower portion includes a shoulder to receive a hanger. The upper portion may seal the bore of the wellhead assembly and provide full bore access to the bore of the wellhead assembly.

24 Claims, 19 Drawing Sheets

INTEGRATED WELLHEAD ASSEMBLY

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations.

During operation of such systems, the well may undergo various operational stages. For example, many wells begin as naturally flowing wells such that, during production, the mineral may be under sufficient pressure to flow out of the well (referred to as "free flow"). In such systems, various components may be included to protect the production system from the pressures in the well. As the pressure in the well declines, additional pressure may be added to the well to maintain production. Such systems and corresponding components may be referred to as "artificial lift" systems and components. However, converting from a free flowing well to an artificial lift system (or vice-versa) requires a change in the wellhead and/or wellhead configuration to accommodate the artificial lift system and components, resulting in increased cost and delayed production. Further, many artificial lift systems have numerous separate components that require installation and configuration to ensure adequate operation of the artificial lift system.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present invention include an integrated wellhead assembly that enables change from free flow production to an artificial lift production without reconfiguration of the wellhead assembly. Further, the integrated wellhead assembly may provide full bore access to the well without reconfiguration or removal of the wellhead. The wellhead assembly may include internal sealing components, such as rams, that may be retracted to provide the full bore access. In some embodiments, the integrated wellhead assembly may include an integrated sealing component for sealing to artificial lift components. In another embodiment, the wellhead assembly may include a side tube extending into and providing additional fluid access to the bore.

Figure 1:
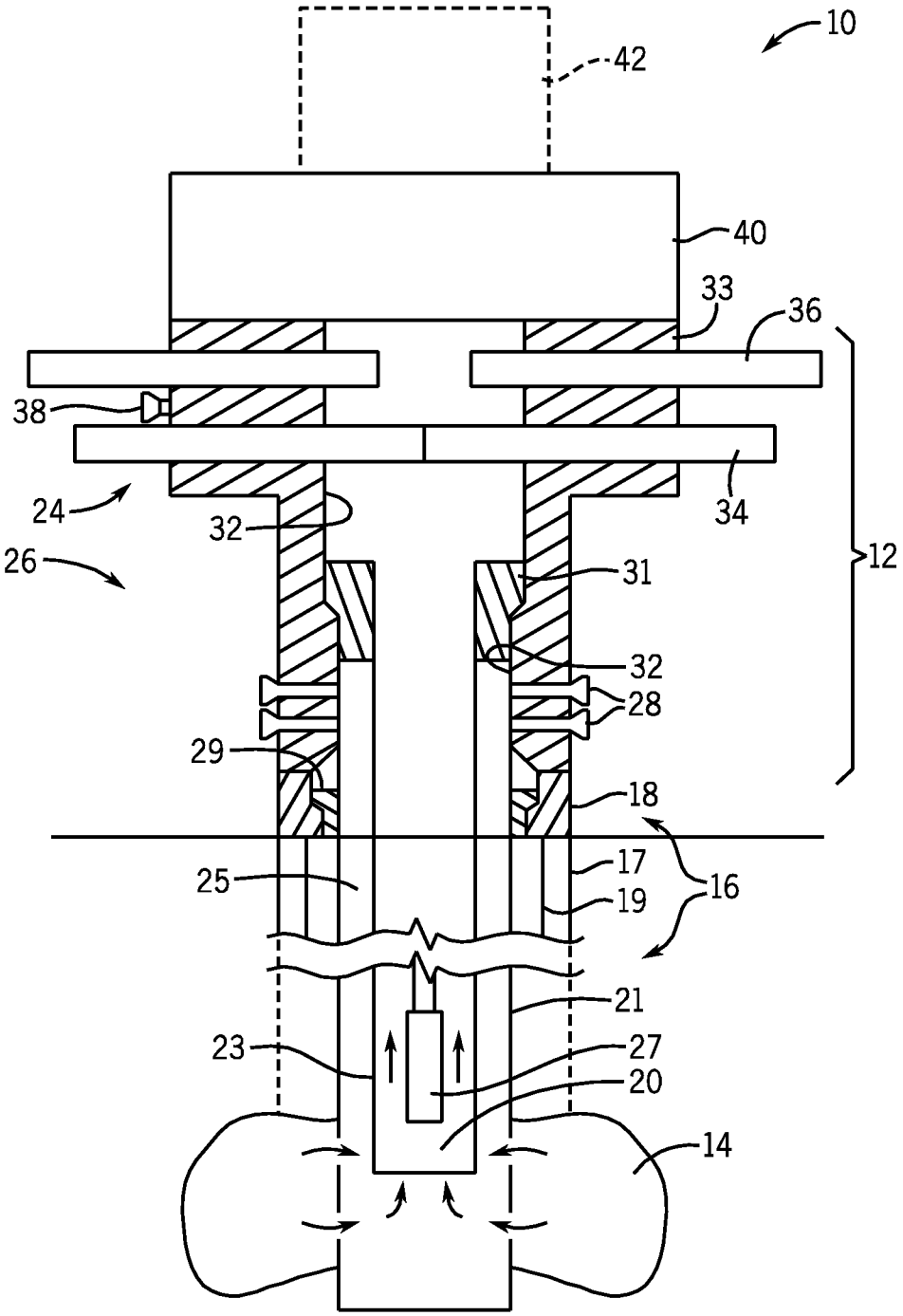
FIG. 1 is a schematic illustration of an embodiment of a mineral extraction system having an integrated wellhead assembly.

FIG. 1 is a block diagram that illustrates an embodiment of a mineral extraction system 10 having an integrated wellhead assembly 12. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes an integrated wellhead assembly 12 coupled to a mineral deposit 14 via a well 16. The well 15 is generally comprised of a series of concentric tubes or casing strings. The outermost casing is the conductor 17, inboard, of which are the outer casing 19, the production casing 21, and production tubing 23, respectively. The conductor 17 and the outer casing 19 may be cemented to one another, and the production casing 21 may be cemented to the outer casing 19. The space between the production casing 21 and the production tubing 19 define an annulus 25 that provides access to the mineral deposit 14. Ultimately, fluid in the mineral deposit is produced to the surface through the production tubing 23. As such, an artificial lift device, such as a pump 27, may be located in the production tubing to bias the fluid toward the surface. An articulated rod, often a polished rod, may be linearly or rotational actuated to motivate a pumping mechanism. The well 16 also includes a wellhead hub 18, such as a casing head, and a well-bore 20. The wellhead hub 18 generally includes a large diameter hub that is disposed at the termination of the well-bore 20. The wellhead hub 18 provides for the sealable connection of the wellhead assembly 12 to the well 16, and provides support for a casing hanger 29 that carries the production casing 23.

The wellhead assembly 12 may be coupled to multiple components that control and regulate activities and conditions associated with the well 16. For example, the wellhead assembly 12 may generally be coupled to (or may include) bodies, spools, valves and seals that route produced minerals from the mineral deposit 14, provide for regulating pressure in the well 16, and provide for the injection of chemicals into the well-bore 20.

The integrated wellhead assembly 12 includes an upper portion 24 and a lower portion 26, each having a bore 32. As explained further below, the upper portion 24 and lower portion 26 may be integrally coupled to form a single unit, e.g., an integrated assembly. For example, the upper portion 24 and lower portion 26 may be cast as a single unit, welded together to form a single unit, etc.

The lower portion 26 may include one or more side ports (e.g., inlets or outlets) 28 to provide fluid connections to the bore 32 of the lower portion 26. The ports 28 may be in fluid communication with the annulus 25 and, as such, provide access to the mineral deposit 14. The lower portion 26 may support a tubing hanger 31 that supports the production tubing 23. If desired, the tubing hanger 31 can include sealing components that isolate the annulus 25 from the bore 32 of the upper portion 24

Advantageously, the wellhead assembly 12 facilities the insertion of various tools into the well-bore as well as access to the mineral deposit 14. For example, components, such as back-pressure valves and plugs, can be run down to the wellhead assembly 12 and disposed in the bore 32 to seal-off the well bore 20, to inject chemicals down-hole, to suspend tools down-hole, to retrieve tools down-hole, and the like.

The upper portion 24 may include blowout-prevention components 33 that provide sealing of the bore 32, such as a set of blind rams 34 that seal against one another and a set of rod rams 36 that seal against the outer surface of a polished rod. In other embodiments, the blowout-prevention components 33 may include only one set of rams, an annular BOP, variable-size ram, sheer rams, etc. In yet other embodiments, the upper portion 24 may include a Flex-Packer® BOP. The upper portion 24 may include a side port (e.g., inlet or outlet) 38, e.g., a flow tee, having any size and type of connection and providing access to the bore 32. As explained further below, during various operational stages of the system 10, the rams 34 and 36 may be closed or opened to provide access to the bore 32, seal the bore 32, or seal around components disposed in the bore 32. The upper portion 24 may provide access to the bore 32 and enable hanging of tubing 30 in the lower portion 26, yet also provide compatibility with an artificial lift system 27, such as a progressing cavity pump system and sucker rod/beam pump system. Thus, the upper portion 24 may provide the functionality of, and may be referred to, as a composite pumping tee (CPT) head.

The wellhead assembly 12 may include a sealing component 40 integrally or separately coupled to the upper portion 24. The sealing component 40 may be a sealing component configured for sealing additional components 42 to the assembly 12. For example, in one embodiment, the sealing component 40 may be a stuffing box (or other type of gland seal) and the additional component 42 may be a drivehead for an artificial lift system, such as a progressing cavity pump system. In other embodiments, the sealing portion 40 may be removed and the other component 42 may include a blowout preventor (BOP), a tree, or any other component of the mineral extraction system 10. In some embodiments, the upper portion 24 may also receive any other sealing component 40 or coupling, such as flanges, timesaver couplings, etc.

As mentioned above, the integrated wellhead assembly 12 may enable conversion between free flow production operation, artificial lift production operation, and various workovers without removal and/or reconfiguration of the wellhead assembly 12. That is, the wellhead assembly 12 may accommodate a variety of operations, thus reducing the time and cost associated with converting between operations of the mineral extraction system 10. During such conversions and operations, the wellhead assembly 12 may remain coupled to the hub 18, and various components may be installed in or coupled to the wellhead assembly 12.

Figure 2A:
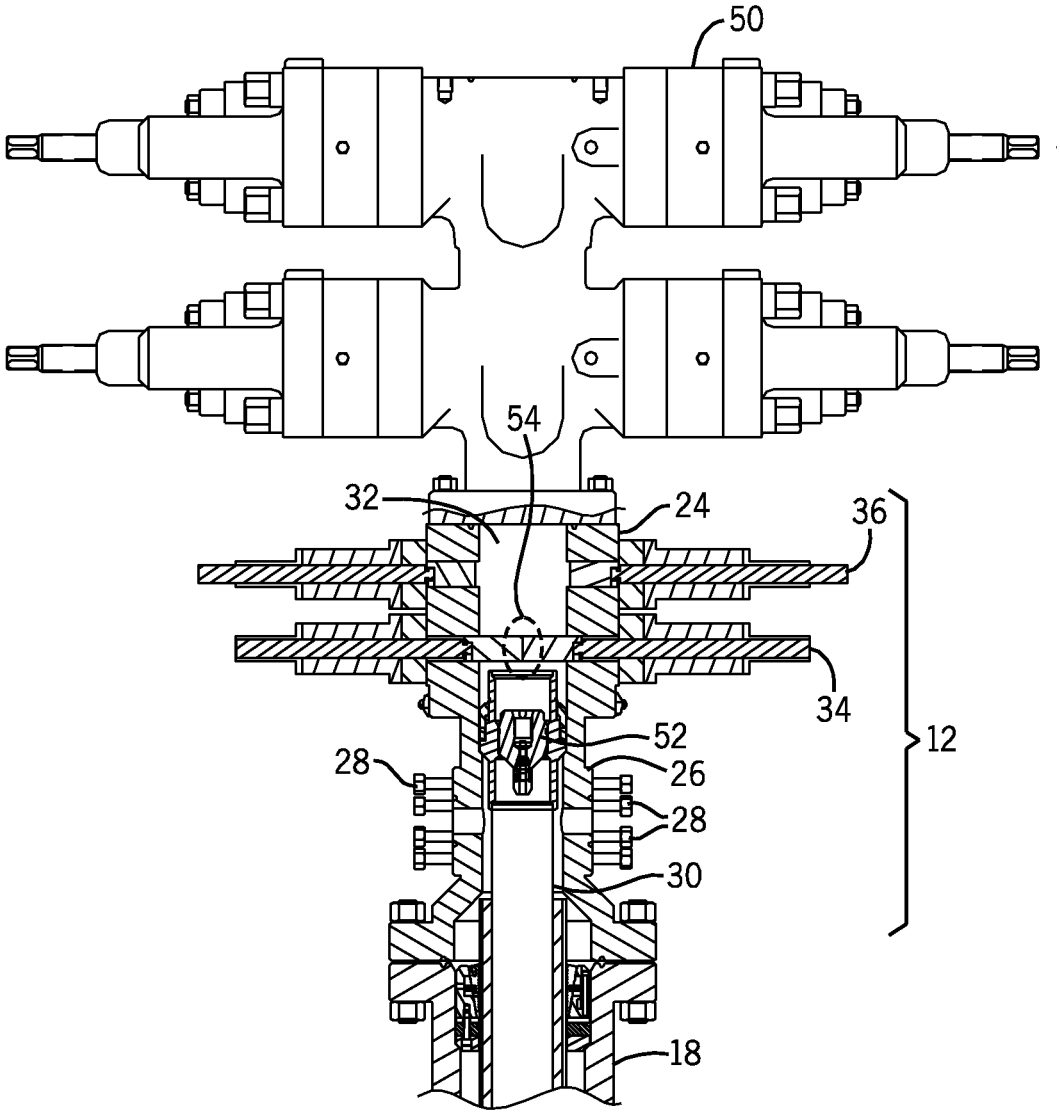
FIGS. 2A-2D are schematic illustrations of various operations using an integrated wellhead assembly in accordance with an embodiment of the present invention.
Figure 2B:
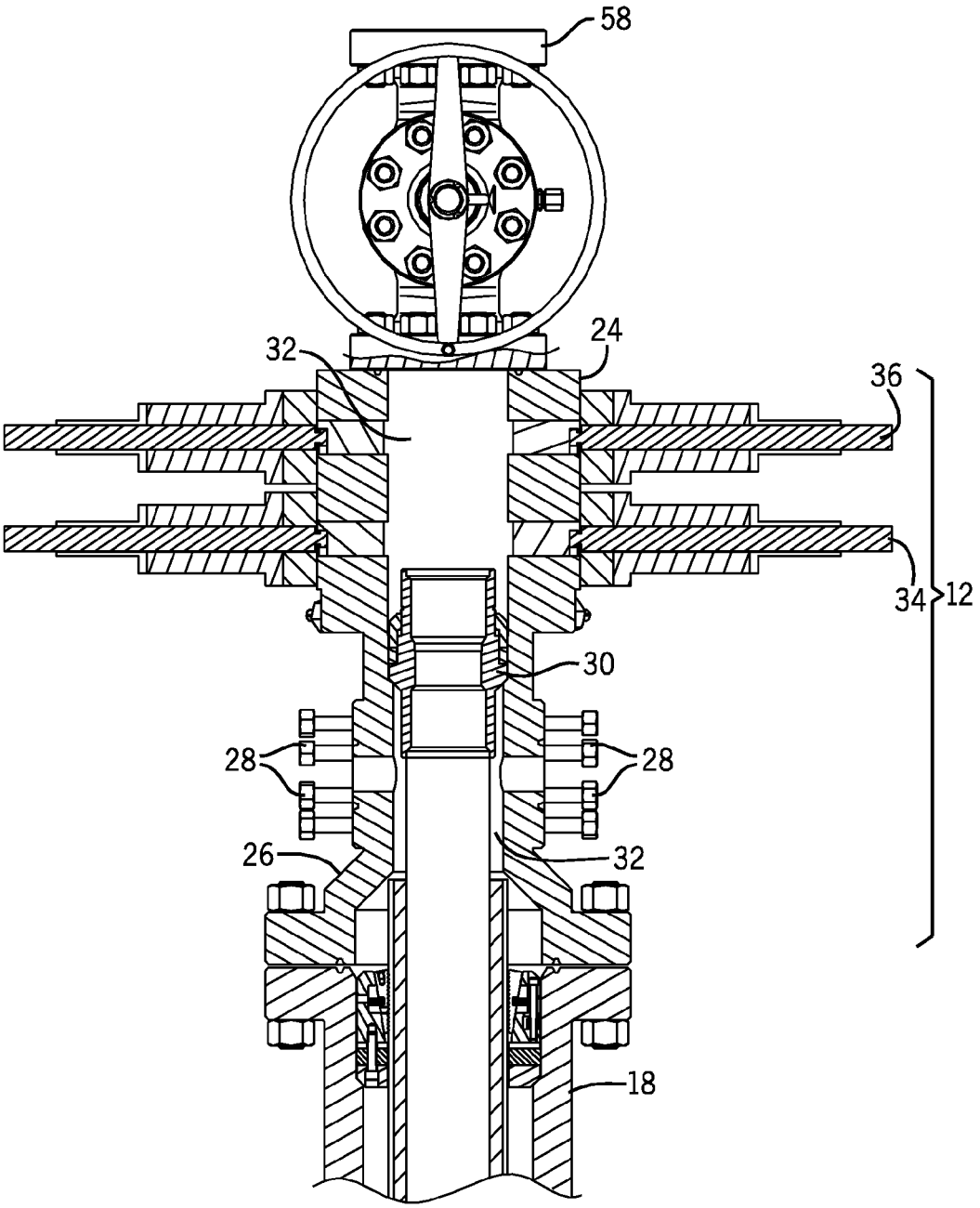
Figure 2C:
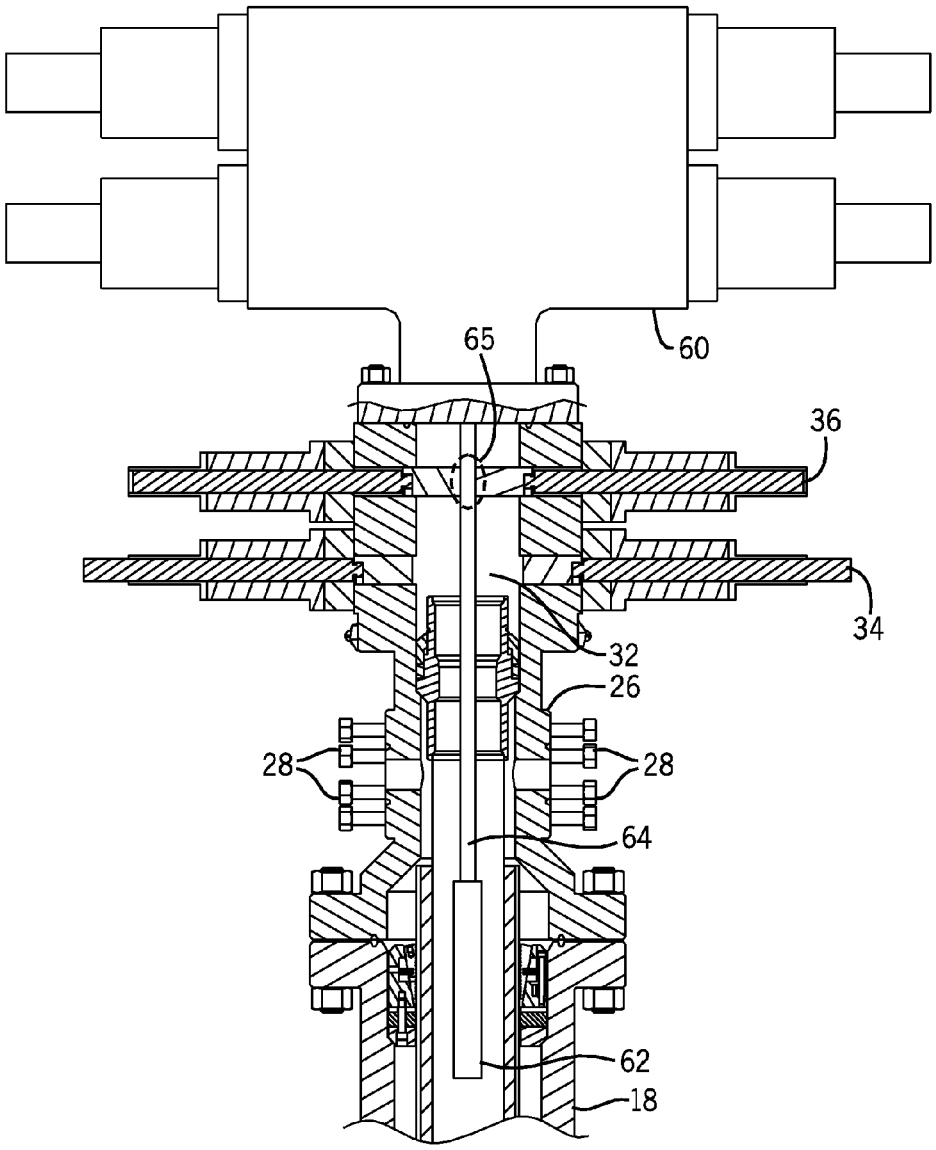
Figure 2D:
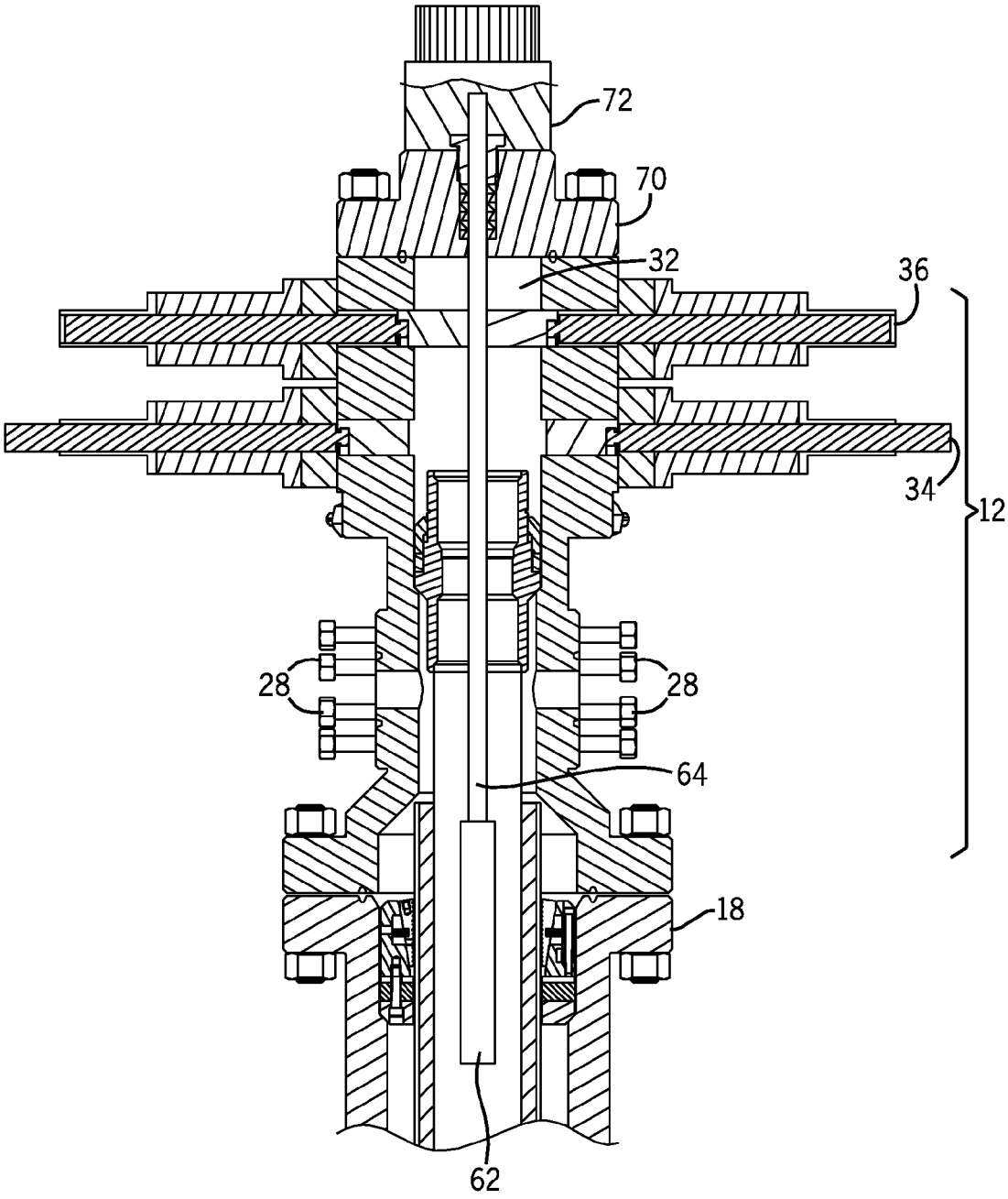

FIGS. 2A-2D depict various operations using the wellhead assembly 12 in accordance with an embodiment of the present invention. FIG. 2A depicts a workover operation in a free flow well, FIG. 2B depicts free flow production operation of wellhead assembly 12, FIG. 2C depicts workover operation in an artificial lift well, and FIG. 2D depicts artificial lift production operation of the wellhead assembly 12. The operations depicted of FIGS. 2A-2D are examples and are not limiting on the operations supported by the wellhead assembly 12. In other embodiments, the wellhead assembly 12 may provide for other stages of operation not depicted in FIGS. 2A-2D. However, regardless of the type of operation, the wellhead assembly 12 remains coupled to the well 16 and is not removed and/or reconfigured during the operations or conversions between operations.

Turning now to FIG. 2A, the wellhead assembly 12 is depicted during workover of a free flow well 16 in accordance with an embodiment of the present invention. For example, FIG. 2A may depict workover to convert the well 16 from drilling to production through the installation of a tubing hanger 31 and production tubing 23, etc. During the operation depicted in FIG. 2A, the wellhead assembly 12 may be coupled to a BOP 50. The BOP 50 may be coupled to the upper portion 24 of the wellhead assembly 12 through a flange, union nut, or any other suitable connection. The exemplary BOP 50 includes blind rams and rams configured to seal against the production tubing. Thus, by articulating the rams, the tubing head and production tubing can be installed while maintaining isolation between the annulus 25 and bore 20 and the external environment on the surface. In addition, the blowout prevention components 33 of the wellhead assembly can be articulated to future assist in the isolation of the bore and the external environment. It is envisaged that the certain embodiments of the present invention may facilitate the installation and removal of production tubing without the need for an external pressure control device like the BOP 50.

During the workover, the wellhead assembly 12 may provide for additional sealing of the bore 32 and the well 16. For example, a check valve 52 or isolation plug, may be installed in the hanger 31 to provide a sealing mechanism between the bore 32 of the upper portion 24 and the bore 20 defined by the production tubing 23. Additionally, the blind rams 34 of the upper portion 24 may be closed to seal off the bore 32 (as illustrated by encircled region 54). The blind rams 34, or other blowout prevention components 33, may be manually or automatically (e.g., hydraulically, pneumatically, electrically etc.) actuated. The blind rams 34 may provide sealing of the well 16 during installation and/or removal of the tubing BOP 50. In the workover operation, after installation of the tubing BOP 50, the blind rams 34 may be opened (e.g., manually or automatically retracted) to expose the bore 32 and enable insertion or removal of the check valve 52, the hanger 31, and/or the tubing 30.

After workover of the well 16, the well 16 may operate in free flow production so that the mineral deposit 14 may produce through the wellhead 12, such as through the production tubing 30 and out of the system 10 to shipping or storage facilities. FIG. 2B depicts such a stage of operation of the wellhead 12 in accordance with an embodiment of the present invention. The wellhead 12 may be provide for conversion between free flow workover (as shown in FIG. 2A) and free flow production without reconfiguration and/or removal of the wellhead 12 or any components below the wellhead 12. As shown in FIG. 2B, conversion to free flow production may include removal of the tubing BOP 50 and installation of a "christmas tree" 58 on the upper portion 24 of the wellhead 12. The tree 58 may be directly coupled to the upper portion 24 or may be coupled by a separate flange or other coupling between the wellhead 12 and the tree 58.

The tree 58 generally includes a variety of flow paths (e.g., bores), valves, fittings, and controls for operating the well 16. For instance, the tree 58 may include a frame that is disposed about a tree body, a flow-loop, actuators, and valves. Further, the tree 58 may provide fluid communication with the well 16. Minerals extracted from the well 16 (e.g., oil and natural gas) may be regulated and routed via the tree 58. Accordingly, produced minerals flow from the well 16 via the wellhead assembly 12 and/or the tree 58 before being routed to shipping or storage facilities. Thus, the tree 58 may enable further routing of produced minerals flowing through the tubing 30 (installed during the free flow workover depicted in FIG. 2A).

As shown in FIG. 2B, the blind rams 34 and the rod rams 36 may be retracted to expose the full bore 32 of the wellhead assembly 12. The full bore 32 enables routing of minerals to the tree 58. In fact, the bore 32 may be sized to allow the insertion of tools into the production casing 25 in the case when the production tubing 23 has been removed. The blind rams 34 may still provide for sealing of the well 16, such as in the event of an overpressure situation, by manual or automatic closing of the blind rams 34. With the blind rams 34 in a closed position, the bore 20 and annulus 25 are isolated from the external environment, and the sealing component 40, whether that is a tree 58 or a BOP 50 or other component may be removed without exposure of the external environment.

As mentioned above, in some embodiments it may be desirable to convert the well 16 to artificial lift production, which may use a pumping mechanism to increase pressure in the well 16 to enable further extraction and production of the mineral deposit 14. FIG. 2C depicts conversion of the system 10 to artificial lift production in accordance with embodiment of the present invention. As shown in FIG. 2C, the tree 58 may be removed and a rod BOP 60 may be installed on the upper portion 24 of the wellhead assembly 12, without removal and/or reconfiguration of the wellhead assembly 12. The rod BOP 60 may provide well protection during running and landing of a pump 62 and rods 64 in the well 16. During installation of the pump 62 and rods 64, the blind rams 34 and rod rams 36 may be fully opened (either manually or automatically retracted) to expose the full bore 32 of the wellhead assembly 12 and enable installation and/or removal of the hanger 31 and tubing 30, and installation of the pump 62, rods 64, and any insertion and/or removal of any associated tools and/or components.

After installation of the artificial lift components, e.g., the pump 62 and the rods 64, the rod rams 36 of the wellhead assembly 12 may be closed to seal around the rods 64 and seal the well 16. In this configuration, the wellhead assembly 12 may enable hang off of the system 10 to the capacity of the rod rams 36, such a closing the rod rams 36 around a rod coupling 65. The wellhead assembly 12 may provide for workover to convert the well 16 to artificial lift without reconfiguration and/or removal of the wellhead assembly 12. Similarly, the wellhead assembly 12 may provide for workover to convert the well to free flow production or other operations.

FIG. 2D depicts operation of the wellhead assembly 12 in artificial lift production in accordance with an embodiment of the present invention. As described above, the wellhead assembly 12 may be converted to artificial lift production through installation of the pump 62 and rods 64, such as during the workover depicted in FIG. 2C. As shown in FIG. 2D, conversion to artificial lift production may include removal of the rod BOP 60 and installation of a stuffing box 70 on the upper portion 24 of the wellhead assembly 12. The stuffing box 70 may be coupled to the wellhead assembly 12 through a flange or any other suitable type of coupling. In other embodiments, the stuffing box 70 may be integral to the upper portion 24 of the wellhead assembly 12, such that installation of the stuffing box 70 is not necessary when converting to artificial lift production.

The stuffing box 70 may provide for coupling and sealing of artificial lift equipment, e.g., a drivehead 72, to the rods 64 and the wellhead assembly 12. Additionally, the side port 38 of the upper portion 24 of the wellhead assembly 12 may operate as a flow tee for the artificial lift system to direct extracted minerals. As also shown in FIG. 2D, during artificial lift production the rod rams 36 and the blind rams 34 may be opened (e.g., manually or automatically retracted) to expose the full bore 32 of the wellhead assembly 12 and enable routing of the produced mineral from the well 16.

The wellhead assembly 12 may be converted from artificial lift production, as shown in FIG. 2D, to workover, as shown in FIG. 2C, and back to free flow production, as shown in FIG. 2B, without reconfiguration and/or removal of the wellhead assembly 12. For example, conversion of the wellhead assembly 12 from artificial lift production to free flow production may include removal of the stuffing box 70 and installation and removal of the check valve 52, the tubing BOP 50, and/or the hanger 31 and tubing 30. Again, the rod rams 36 and blind rams 34 may be opened or closed as desired to provide sealing of the well 16 and access to the bore 32 (such as for removal and/or installation of another hanger and tubing). In other embodiments, the wellhead assembly 12 may be converted from artificial lift production to free flow production by closing the rod rams 36, removing all artificial lift equipment above the upper portion 24, and hanging off the rods 62 below the rod rams 36.

Figure 3:
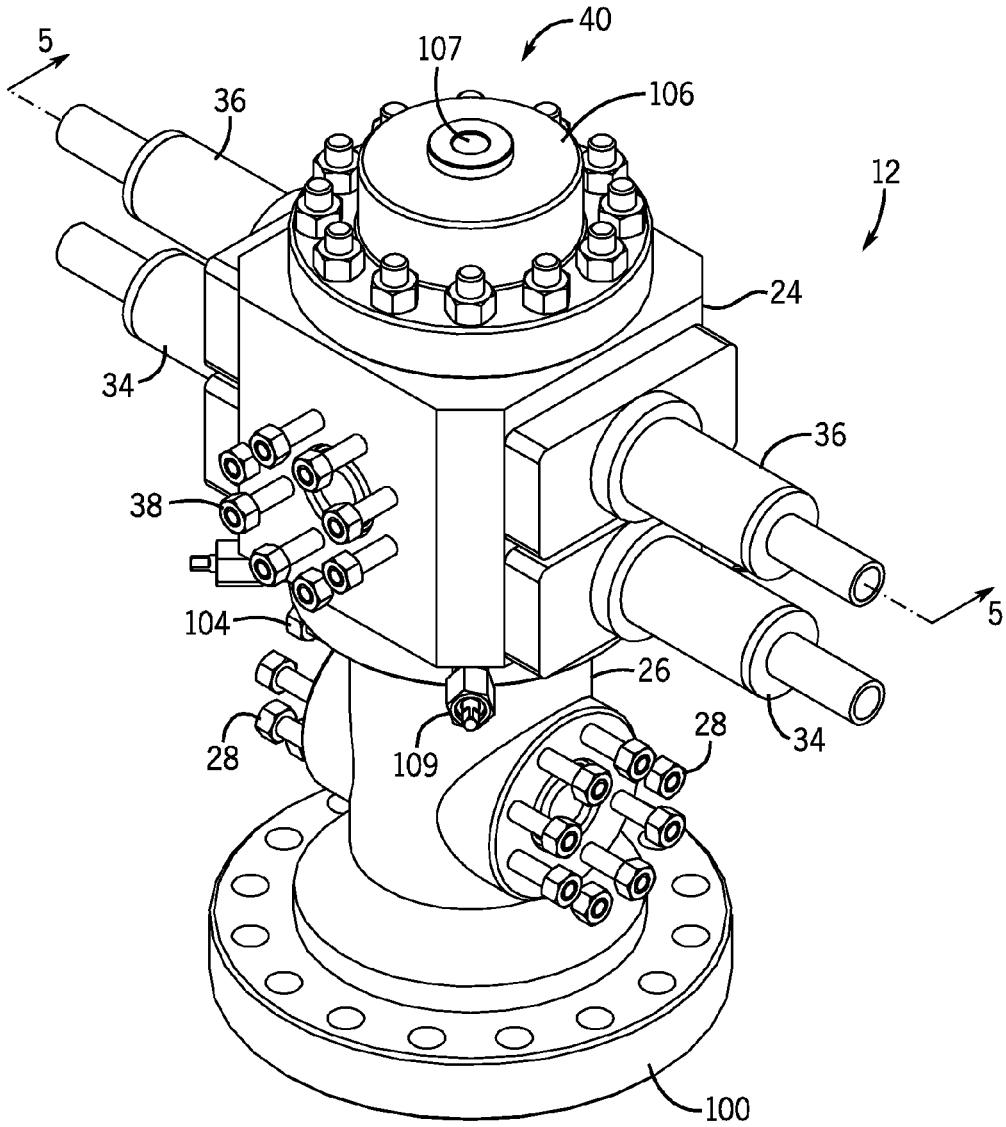
FIG. 3 depicts a perspective view of an embodiment of an integrated wellhead assembly.
Figure 4:
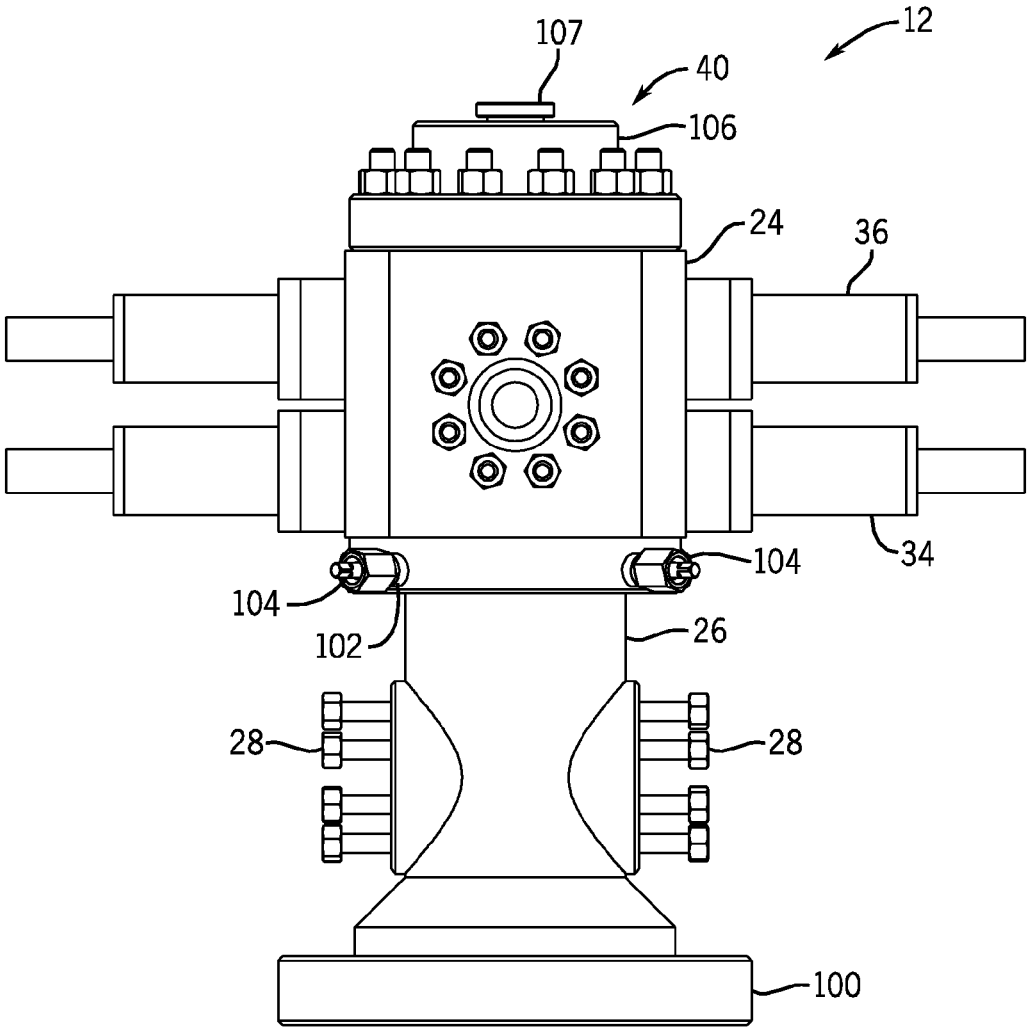
FIG. 4 depicts a side view of an embodiment of an integrated wellhead assembly of FIG. 3.

FIGS. 3 and 4 depict a perspective view and a side view respectively of the integrated wellhead assembly 12 in accordance with an embodiment of the present invention. Referring generally to FIGS. 3 and 4, the wellhead assembly 12 includes an upper portion 24 and lower portion 26 forming an integral assembly (i.e., single unit) as described above. As shown in FIGS. 3 and 4, the lower portion 26 may include side ports 28 and a flange 100. The flange 100 may be any suitable size and provide for any suitable connection. In some embodiments, the flange 100 may be an 11" American Petroleum Institute (API) 3K flange, or a 7 1/16" API 3K flange. The side ports 28 may be any suitable size and provide for any suitable connection. In one embodiment, the side ports 28 may be 2 1/16" APU 5K studded outlets.

The intersection of the lower portion 26 and upper portion 24 may include fasteners 104 that disposed around the circumference of the assembly 12. The fasteners 104 may include lock screws or other suitable fasteners and may insert into the bore 32 of the assembly 12 to engage a hanger or other component disposed in the bore 32.

As illustrated in FIGS. 3 and 4, the upper portion 24 may include the blind rams 34, the rod rams 36, and the side port 38, e.g., a flow tee. Also illustrated in FIG. 3 is the sealing component 40, e.g., a stuffing box 106, coupled to the upper portion 24. The stuffing box 106 may include an orifice 107 to receive rods or other artificial lift components. In some embodiments, as shown in FIG. 3, the stuffing box 106 may be coupled to the upper portion 24 by a flanged connection or other suitable coupling. In other embodiments, the stuffing box 106 may be integrally coupled to the upper portion 24.

Figure 5:
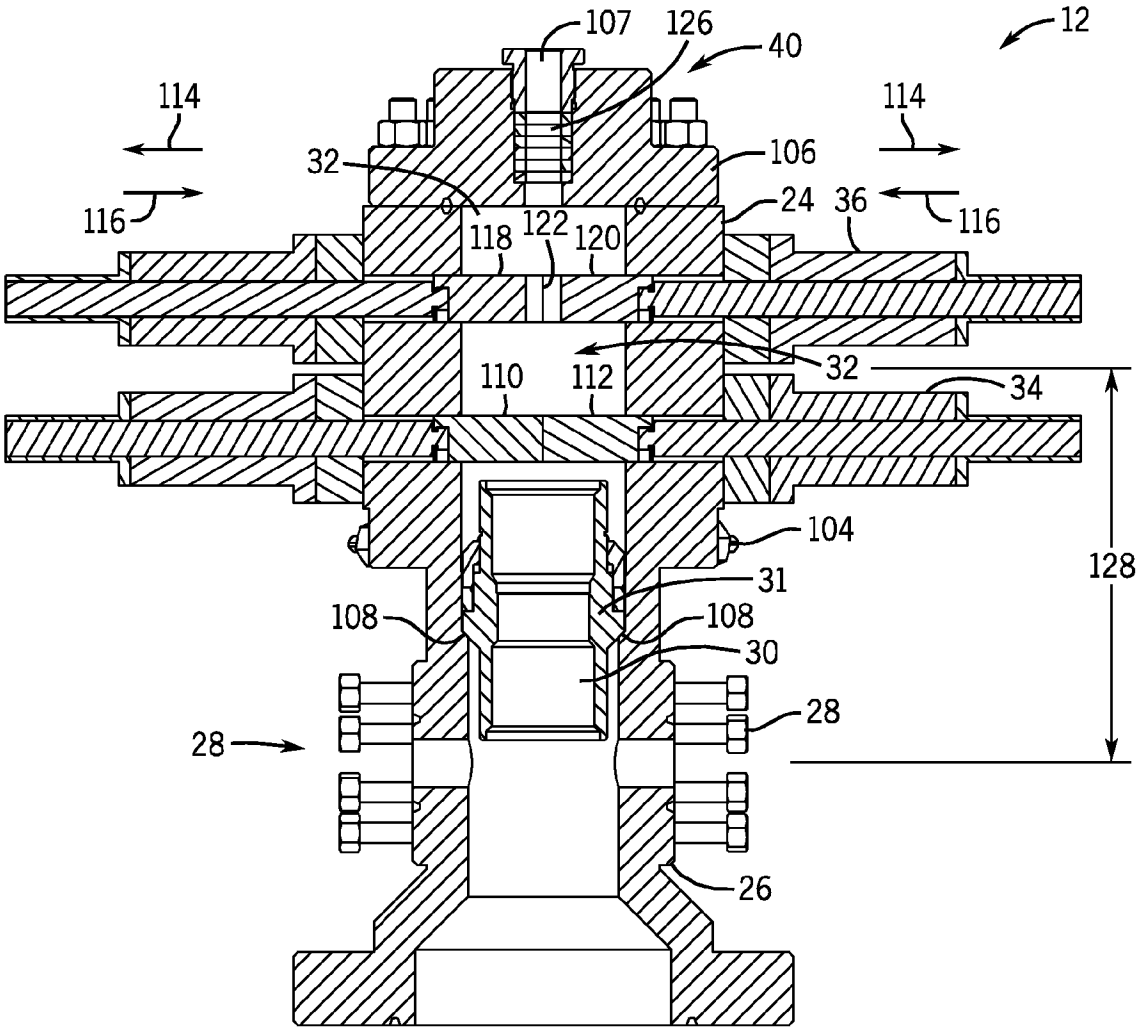
FIG. 5 is a cross-section of an embodiment of the integrated wellhead assembly taken along line 5-5 of FIG. 3.

FIG. 5 is a cross-section of the wellhead assembly 12 taken along line 5-5 of FIG. 3 in accordance with an embodiment of the present invention. FIG. 5 illustrates disposal of the tubing hanger 31 and production tubing 30 in the bore 32 of the wellhead assembly 12. The hanger 31 may be landed on a shoulder 108 of the lower portion 26. The hanger 31 may be secured by the fasteners 104 (e.g., lockscrews) inserted into the bore 32 of the wellhead assembly 32 to engage the hanger 31. As mentioned above, when inserted into the wellhead assembly 32 the hanger 31 sealably connects the upper portion 24 with the well 16, and carries the production tubing 30 used to route minerals from the well 16.

As also seen in FIG. 5, the rod rams 36 and the blind rams 34 are shown in a closed position. The blind rams 34 may include two components, e.g., blocks 110 and 112, that move in the radial directions indicated by arrows 114 and 116. To open and provide access to the bore 32 of the wellhead assembly 12, the blind rams 34 may be manually (or automatically) retracted, such that blocks 110 and 112 move in the outwardly radial direction as indicated by arrows 114. To seal the well 16, the blind rams 34 may be manually (or automatically) closed (the position depicted in FIG. 5), such that blocks 110 and 112 move in the inward radial direction as indicated by arrows 116. In the closed position, the blocks 110 and 112 meet in the center of the bore 32 to seal the portion of the well 16 below the blind rams 34.

The rod rams 36 may work in a similar manner to the blind rams 34 but, as described above, the rod rams 36 seal around a rod or other component inserted into the bore 32 of the wellhead assembly 12. The rod rams 36 may include two components, e.g., blocks 118 and 120, which move in the radial directions indicated by arrows 114 and 116. To open and provide full access to the bore 32 of the wellhead assembly 12, the rod rams 36 may be manually (or automatically) retracted by moving blocks 118 and 120 in the outward radial direction as indicated by arrows 114. The rod rams 34 may be manually (or automatically) closed (the position shown in FIG. 5), such that blocks 118 and 120 move in the radially inward direction as indicated by arrows 116. In the closed position, the blocks 118 and 120 of the rod rams 36 form an orifice 122 in the center of the bore 32 to seal around a component disposed in the bore 32.

One of, or both of, the blind rams 34 and the rod rams 36 may be opened or closed to facilitate the operations or conversion between operations described above in FIGS. 2A-2D, or any other operation or conversion. Thus, both the blind rams 34 and the rod rams 36 may be retracted to provide full bore access to the bore 32 of the wellhead assembly 12, such as during workover or free flow production. In another example, the blind rams 34 may be closed to seal the well 16 and the rod rams 36 may be opened to facilitate workover of the well 16, such as when converting to/from free flow production and artificial production. Additionally, the rod rams 36 may be closed to seal around a rod or other component and the blind rams 34 may be opened to enable artificial lift production, hang off, or other operations.

The stuffing box 106 may include the orifice 107 to allow insertion of rods 64 for an artificial lift system. The stuffing box 106 may also include sealing components 126, such as annular elastomer seals, to seal against the rods 64 and the well 16. In some embodiments, the stuffing box 106 may provide access to internal components to allow repair and/or replacement without removal of the stuffing box 106, thus providing longer life without removal of a drivehead and replacement of the stuffing box 106. For example, in one embodiment the stuffing box 106 may include a side access panel that may be opened and/or removed to allow access to the sealing components 126.

To further provide for various operations of the mineral extraction system 10, the wellhead assembly 12 also maintains a fixed configuration and position that can accommodate different equipment. As illustrated above, the wellhead assembly 12 includes the shoulder 108 for landing a hanger or other equipment. Thus, operation of the wellhead assembly 12 does not require the addition of tubing heads to provide additional shoulders for landing additional hangers and tubing. Additionally, as shown in FIG. 5, a distance 128 between the upper portion 24 and the lower portion 26, (and the side ports 28 and 28) remains fixed regardless of the operation. The fixed distance 128 provides for easier use of the wellhead assembly 12 during workover and other operations, without necessitating removal of the assembly 12.

Figure 6:
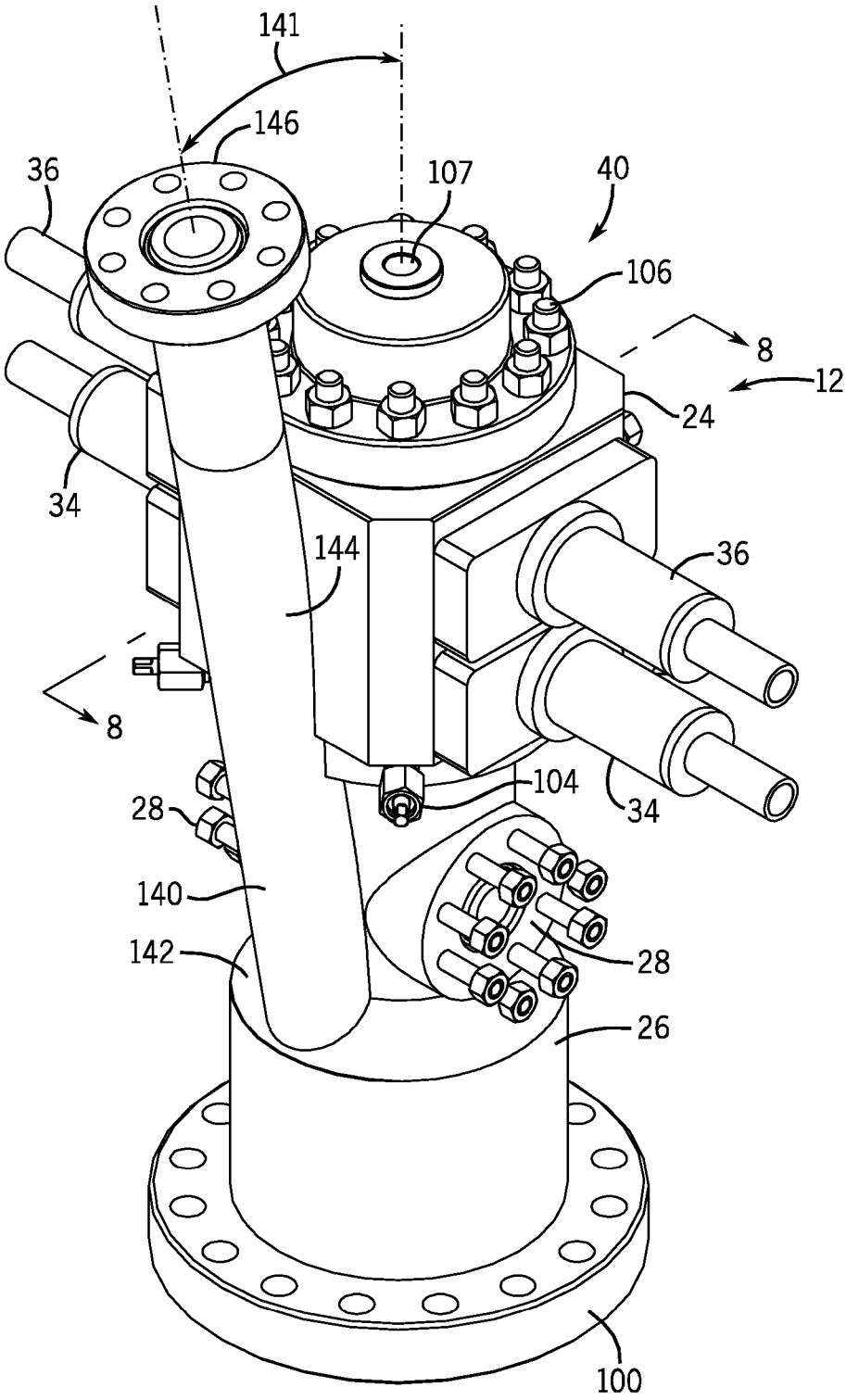
FIG. 6 depicts a perspective view of an embodiment of an integrated wellhead assembly having a side tube.
Figure 7:
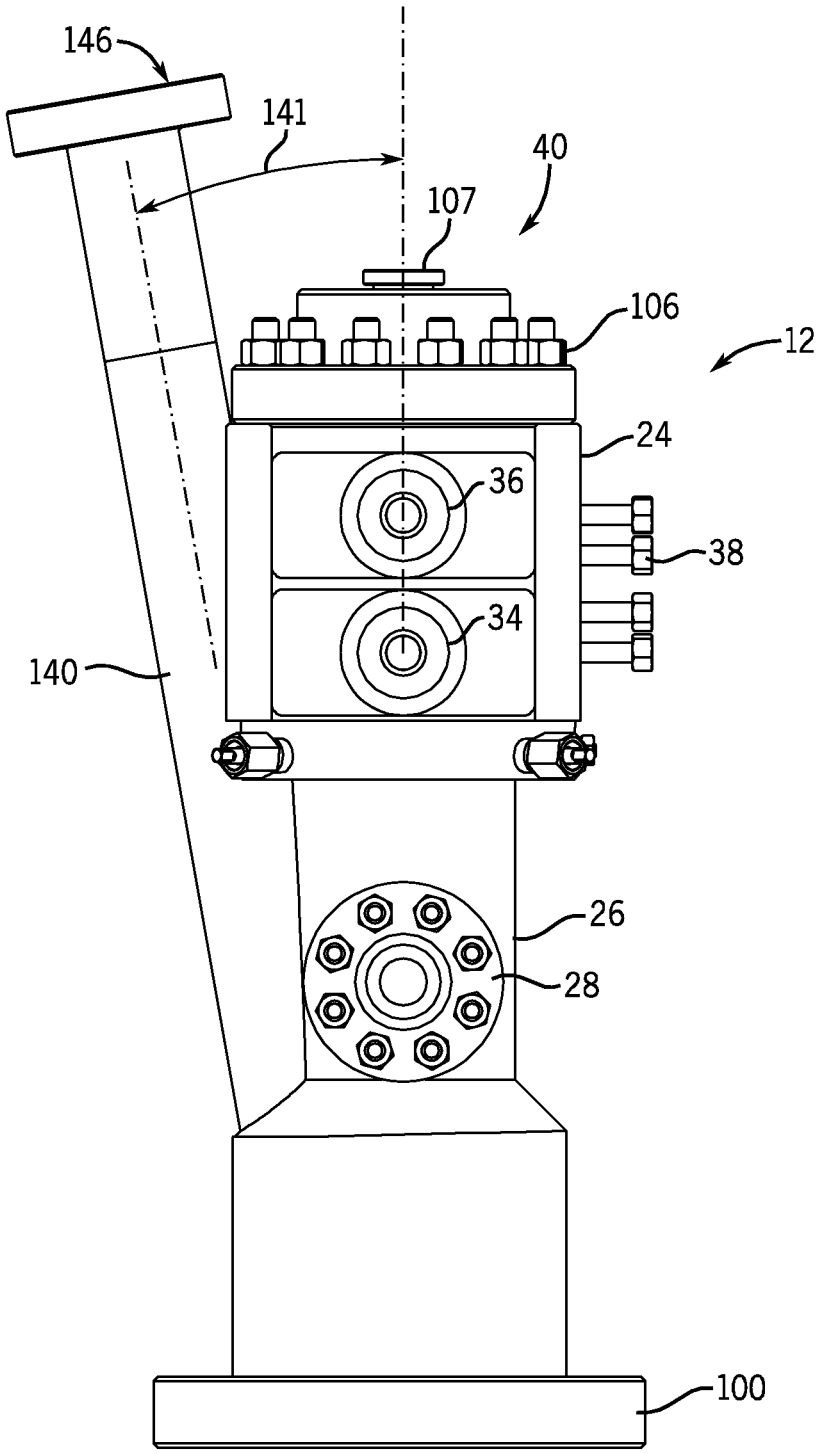
FIG. 7 depicts a side view of an embodiment of the integrated wellhead assembly of FIG. 6.
Figure 8:
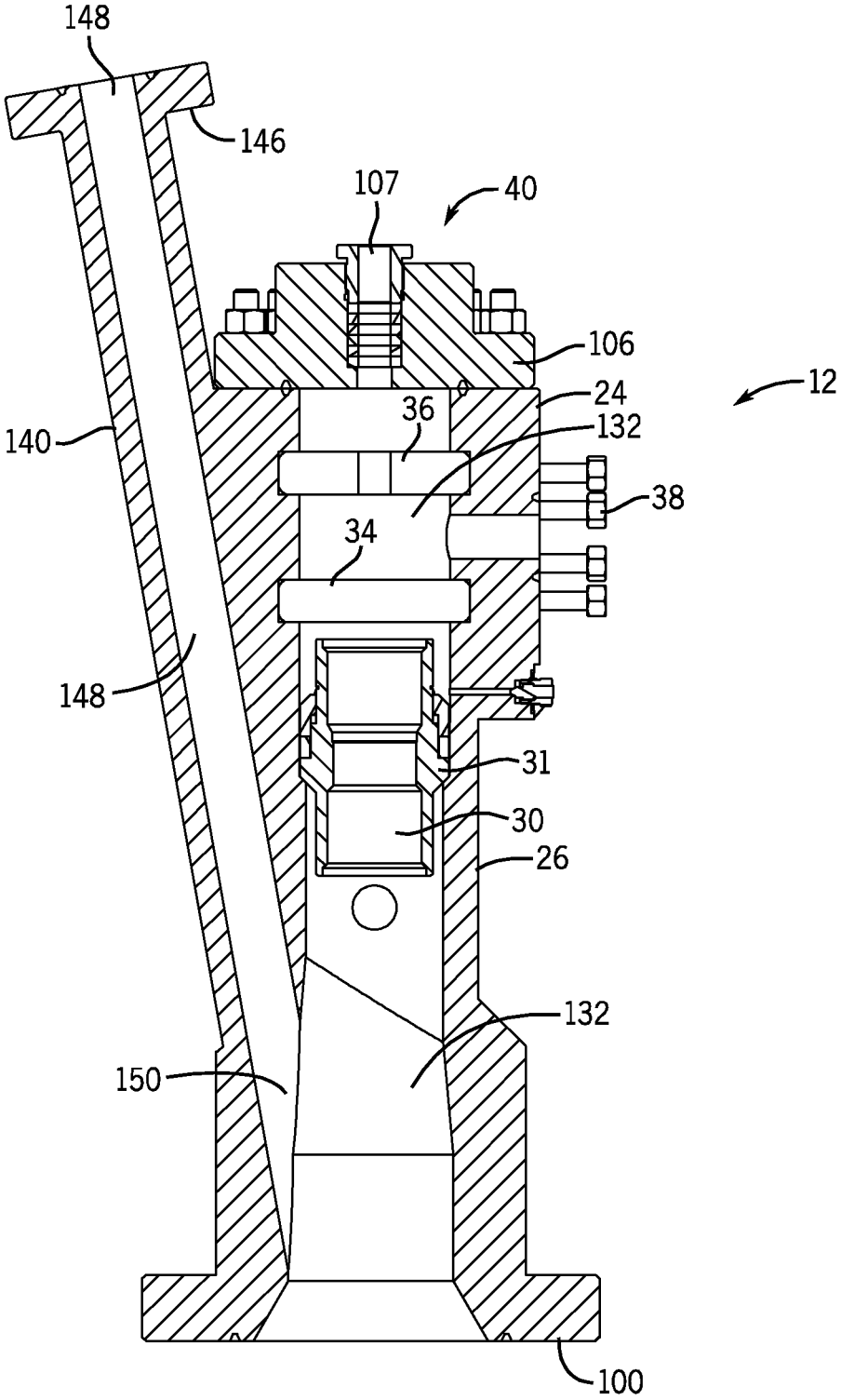
FIG. 8 depicts a cross-section of an embodiment of an integrated wellhead assembly with the side tube taken along line 8-8 of FIG. 6.

In other embodiments, an integrated wellhead assembly 12 may include a side tube that provides for additional operations. FIGS. 6-8 depict the wellhead assembly 12 having a side tube 140 in accordance with another embodiment of the present invention. As described below, the side tube 140 may be used for clean out (e.g., injecting fluids and removing fluids and debris), artificial lift, or production during operation of the system 10. The wellhead assembly 12 having the side tube 140 may be used in any of the stages of operation discussed above in FIGS. 2A-2D.

Turning now to FIGS. 6 and 7, FIG. 6 depicts a perspective view and FIG. 7 depicts a side view of the wellhead assembly 12 with the side tube 140 in accordance with an embodiment of the present invention. The wellhead assembly 12 includes the upper portion 24 having rod rams 36, blind rams 34, and side port 38, and the lower portion 26 having side ports 28 and flange 100. Additionally, a stuffing box 106 is shown coupled to the upper portion 24, although, as mentioned above, any suitable sealing component may be coupled to the upper portion 24.

As seen in FIGS. 6 and 7, the side tube 140 extends from the lower portion 26, such as from a flanged portion 142 of the lower portion 26. The side tube 140 may be integrally coupled to the wellhead assembly 12 to form an integrated assembly 12, e.g., a single unit. For example, the side tube 140 may be welded to the assembly 12 or the assembly 12 may be cast or otherwise formed as a single unit. The side tube 140 may extend at any suitable angle 141 to clear the wellhead assembly 12. In some embodiments, the angle 141 may be 0 to 90 degrees, 5 to 60 degrees, 5 to 45 degrees, 5 to 15 degrees, e.g., less than approximately 5, 10, 15, 20, 30, 35, 40, or 45 degrees but greater than 0 degrees. Additionally, in some embodiments, the upper portion 24 may include a recessed portion 144 to receive a portion of the side tube 140. The side tube 140 may include a flange 146 to enable coupling of different components to the side tube 140. As explained below, the bore of the side tube 140 may be in fluid communication with the bore 32 of the lower portion 26 of the wellhead assembly 12, and, if production tubing is suspended from the tubing hanger 31, may be in fluid communication with the annulus 25 between the production tubing 23 and the production casing 21.

FIG. 8 depicts a cross-section of the wellhead assembly 12 with the side tube 140 taken along line 8-8 of FIG. 6 in accordance with an embodiment of the present invention. As seen in FIG. 8, the side tube 140 includes a bore 148 in fluid communication with the bore 132 of the wellhead assembly 12. As described above, the upper portion 24 and rod rams 36 and blind rams 34 may function to seal the well 16 or provide full bore access as described above. That is, incorporation of the side tube 140 does not alter or change the functionality of the upper portion 24 of the wellhead assembly 12.

An opening 150 of the side tube 140 may allow for injection and/or removal of fluids to and from the bore 132 of the lower portion 26. The flange 146 may provide for coupling of different devices to the side tube 140. In one embodiment, the side tube 140 may be used for a clean-out operation to remove fill material, e.g., debris, from the wellbore. In other embodiments, the side tube 140 may be used to add a column to the top of the fluid in the well and aid artificial lift production.

Figure 9:
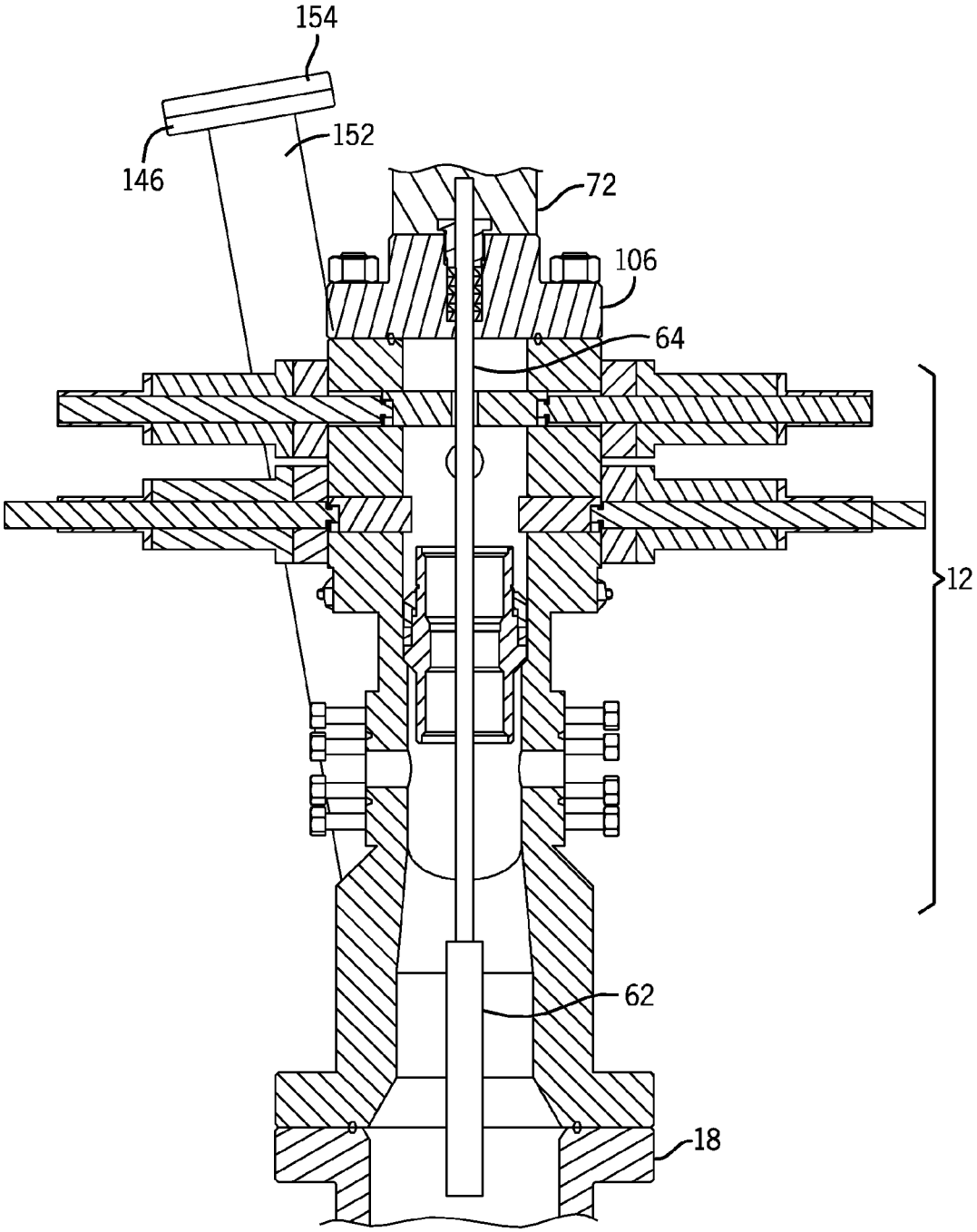
FIG. 9 is a block diagram of an embodiment of an integrated wellhead assembly with the side tube used during artificial lift.

In another embodiment, the side tube 140 may be used for production, either during free flow production or artificial lift production. FIG. 9 depicts a block diagram of the assembly 12 with side tube 140 used during artificial lift production in accordance with an embodiment of the present invention. The artificial lift system may include the components described above, such as a pump 62, rod 62, and drivehead 72. As mentioned above, the drivehead 72 may be coupled to the wellhead 12 by the stuffing box 106, and the stuffing box 106 may also provide sealing of the rod 62 and the drivehead 72.

To enable production through the side tube 140, coil tubing 152 may be installed in the side tube 140 to the opening of the side tube 140. Further, in some embodiments, a sealing element and/or lubricator, such as a stuffing box 154, may be coupled to the top of the side tube 140 by the flange 146. As the artificial life system operates, a mineral may be produced through the annulus of the assembly 12 and through the coil tubing 152 installed in the side tube 140. Such a system may also include valves, fittings, or other components coupled to the top of the side tube 140 to provide for routing of the produced mineral for further processing.

FIGS. 10-13 depict additional embodiments of the wellhead assembly 12 having, for example, a backpressure valve (BPV) prep head, a side panel stuffing box, a tubing rotator, and/or an annular BOP. Any of the features illustrated in the embodiments below may be used in the operations illustrated above in FIGS. 2A-2D. Further, it should be appreciated that the features described below in FIGS. 10-13 may be implemented in different embodiments of the wellhead assembly 12 having various combinations of the features discussed herein.

Figure 10:
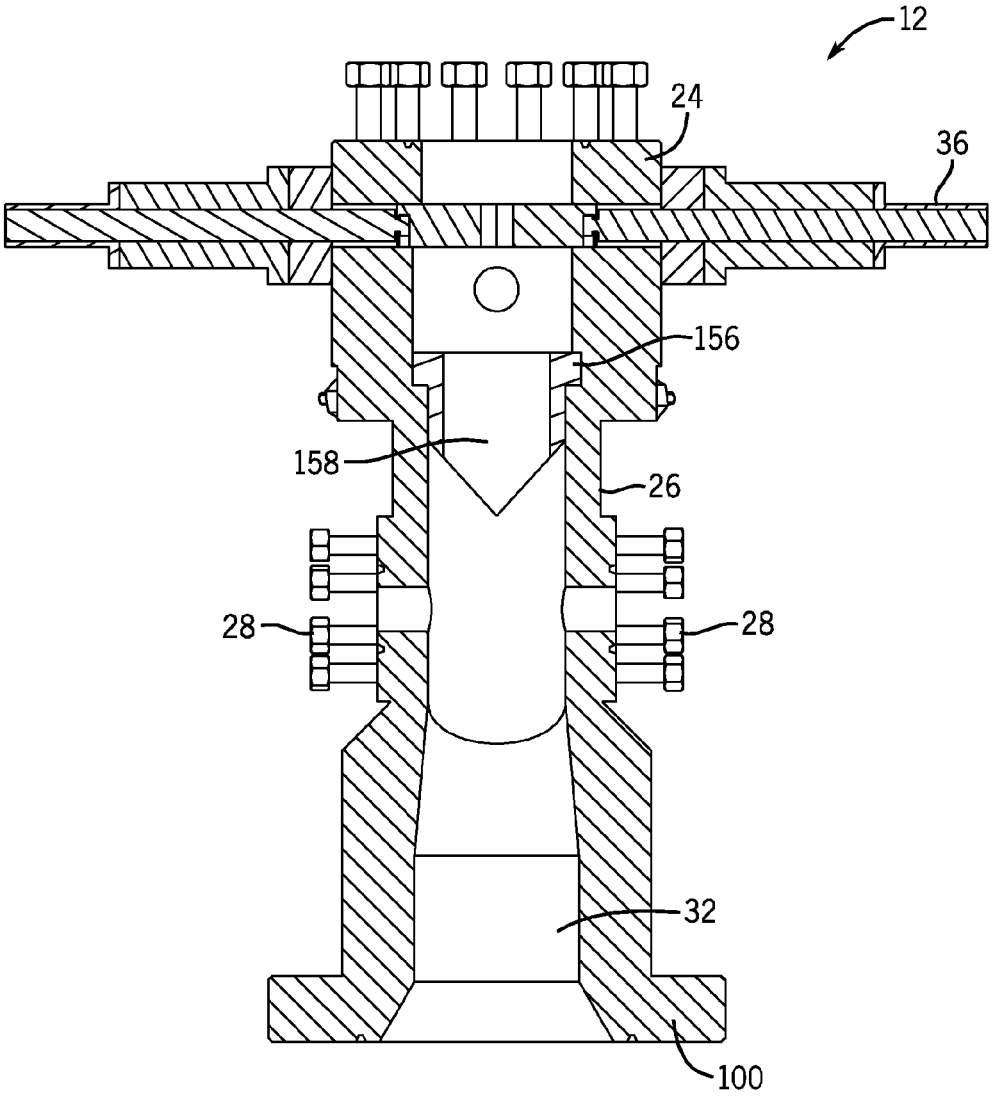
FIG. 10 depicts a cross-section of an embodiment of an integrated wellhead assembly having a backpressure valve prep head.

FIG. 10 depicts the integrated wellhead assembly 12 having a backpressure valve prep head 156 in accordance with an embodiment of the present invention. The backpressure valve prep head 156 may be included in the upper portion 24 of the wellhead assembly 12 and may be configured to receive a backpressure valve 158. In such an embodiment, the upper portion 24 of the wellhead assembly 12 may only include one set of rams, e.g., rod rams 36. The backpressure valve 158 may provide sealing of the well 16 instead of an additional blind rams included in the upper portion 24. In some embodiments, the backpressure valve 158 may be retained by lock screws inserted through the upper portion 24 and into the bore 32. In other embodiments, the backpressure valve 158 may be retained in the bore 32 by one or more lock rings disposed around one or more portions of the backpressure valve 158. Further still, the backpressure valve may be retained by an appropriate mechanism located on an inner surface of the tubing hanger 31.

Figure 11:
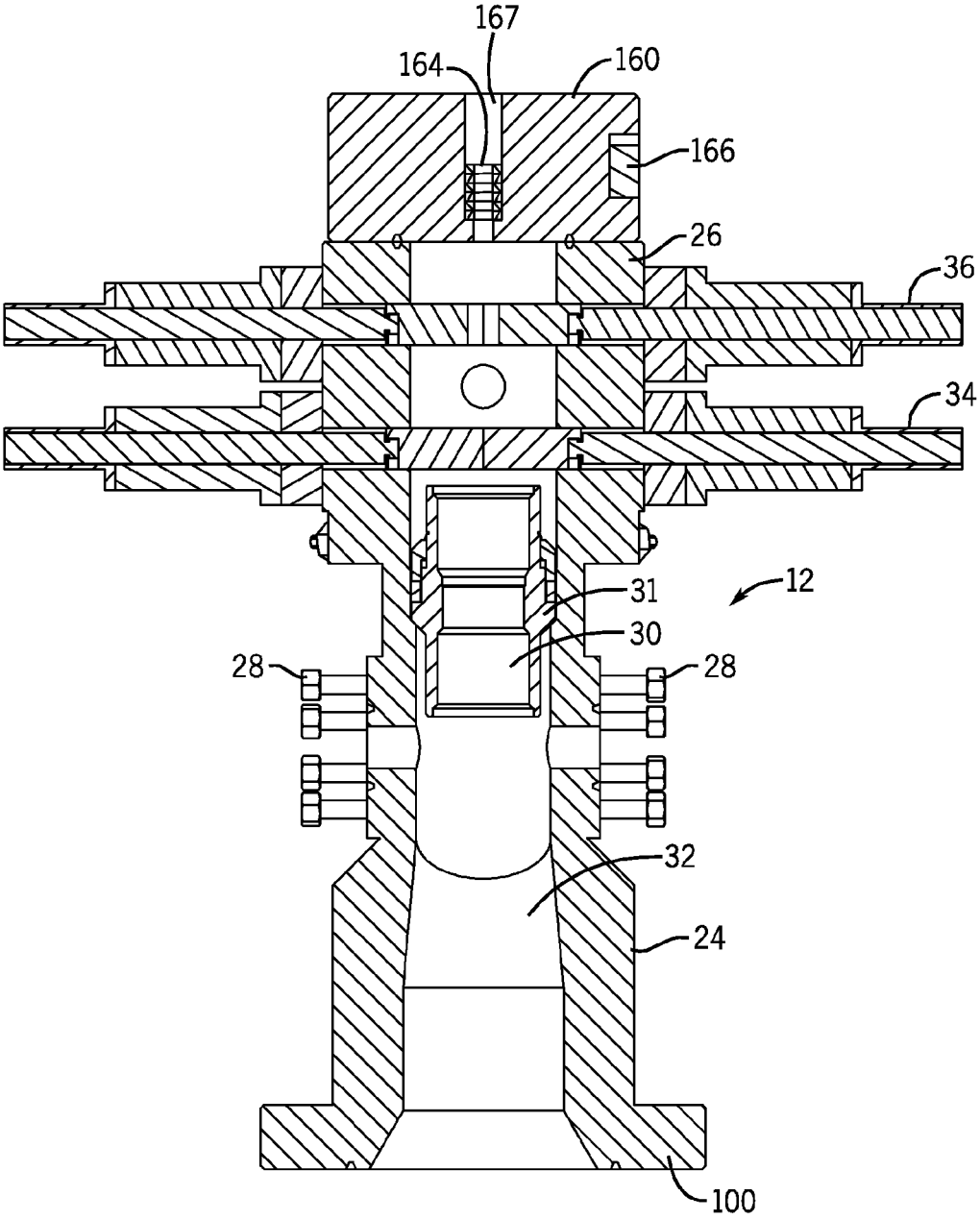
FIG. 11 depicts a cross-section of an embodiment of an integrated wellhead assembly having a side accessible stuffing box.

FIG. 11 depicts the integrated wellhead assembly 12 having a side accessible stuffing box 160 in accordance with an embodiment of the present invention. As described above, the stuffing box 160 may include a plurality of seals 164 (e.g., annular elastomer seals) configured to seal a rod inserted into an orifice 167 of the stuffing box 160. During artificial lift production of the well 16, the seals 164 and/or other components of the stuffing box 160 may be replaced to ensure seal integrity and extend service life of the stuffing box. The stuffing box 160 may include a side panel 166 to provide for access to the seals 164 and/or other components of the stuffing box 160. The side panel 166 provides for repair and/or replacement of the seals 164 and/or other components of the stuffing box 160 without removal of the stuffing box 160, the drivehead, and/or any other components coupled to the upper portion 24 of the wellhead assembly 12. The side panel 166 may be fully removable, and/or may be hinged, bolted, latched, or otherwise secured to the stuffing box 160.

Figure 12:
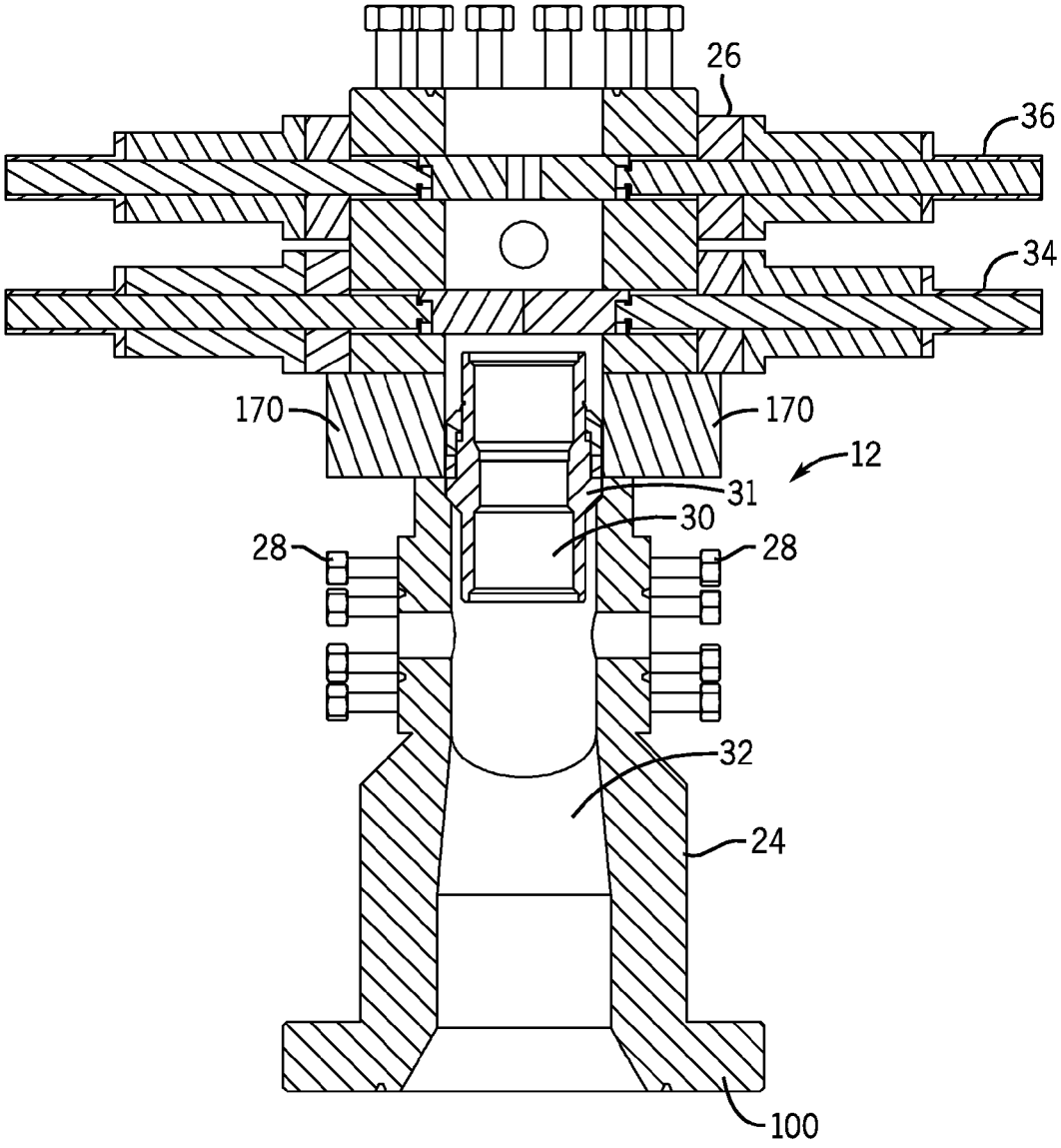
FIG. 12 depicts a cross-section of an embodiment of an integrated wellhead assembly with a tubing rotator.

In other embodiments, the wellhead assembly 12 may include a tubing rotator that rotates tubing installed in the assembly to prevent uneven wear caused by a rod and pumping action of an artificial lift system. FIG. 12 depicts the integrated wellhead assembly 12 with a tubing rotator 170 in accordance with an embodiment of the present invention. The tubing rotator 170 may be disposed at or near the intersection of the upper portion 24 and the lower portion 26 and may include a mechanism that rotates the tubing 30 (and, in some embodiments, the hanger 31). The tubing rotator 170 may be driven by a pump or other suitable drive mechanism. As mentioned above, when a rod is inserted in the wellhead assembly 12 for artificial lift production, the tubing rotator 170 may rotate the tubing to encourage even wear of the tubing 30 as the rod moves in the assembly 12 and contacts the tubing 30. During free flow production, the tubing rotator 170 may be deactivated so that the tubing 30 is not rotated.

Figure 13:
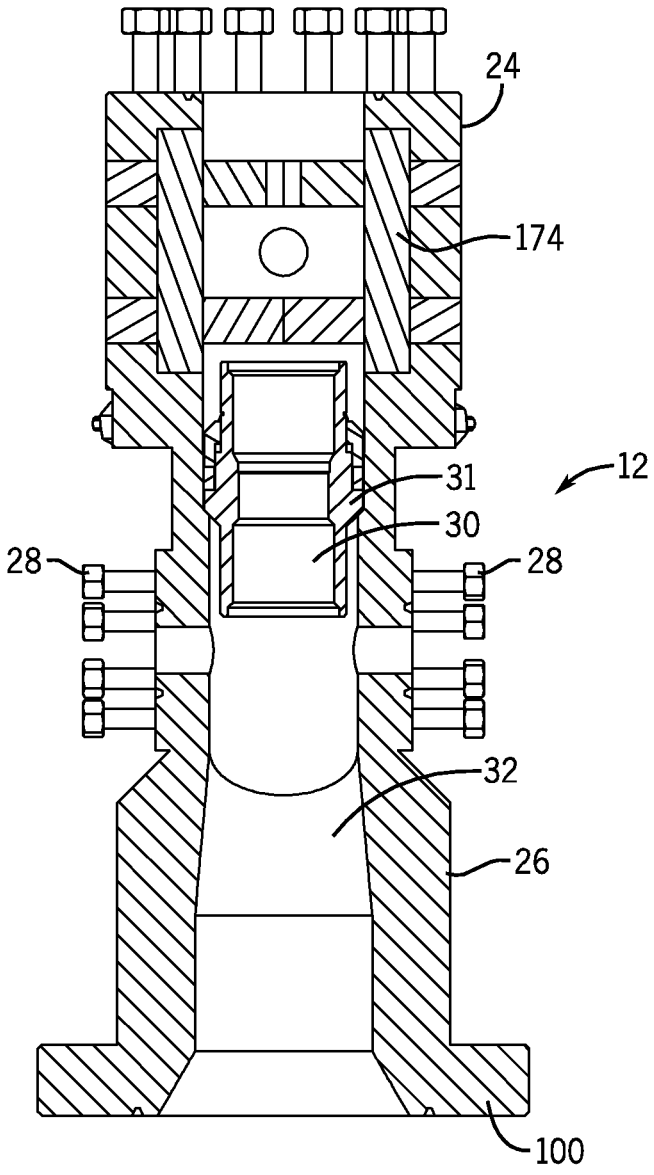
FIG. 13 depicts a cross-section of an embodiment of an integrated wellhead assembly having an annular BOP.

As also mentioned above, in other embodiments the upper portion 24 of the wellhead assembly 12 may include other BOP types. FIG. 13 depicts the wellhead assembly 12 having an annular BOP 174 in accordance with an embodiment of the present invention. The annular BOP 174 may be disposed in the upper portion 24 of the wellhead assembly 12. The annular BOP 174 may be closed to seal the bore 32 of the wellhead assembly 12, and/or, in some embodiments, to provide sealing around tubing, or a rod of an artificial lift system. The annular BOP 174 may include a toroid or torus component disposed circumferentially around the bore 32 that may be contracted radially inward to seal the bore 32 (or around components inserted into the bore). Additionally, the annular BOP 174 may be opened (manually or automatically) to provide access to the full bore 32 of the wellhead assembly 12, such as during workover or for production from the well 16.

Figure 14:
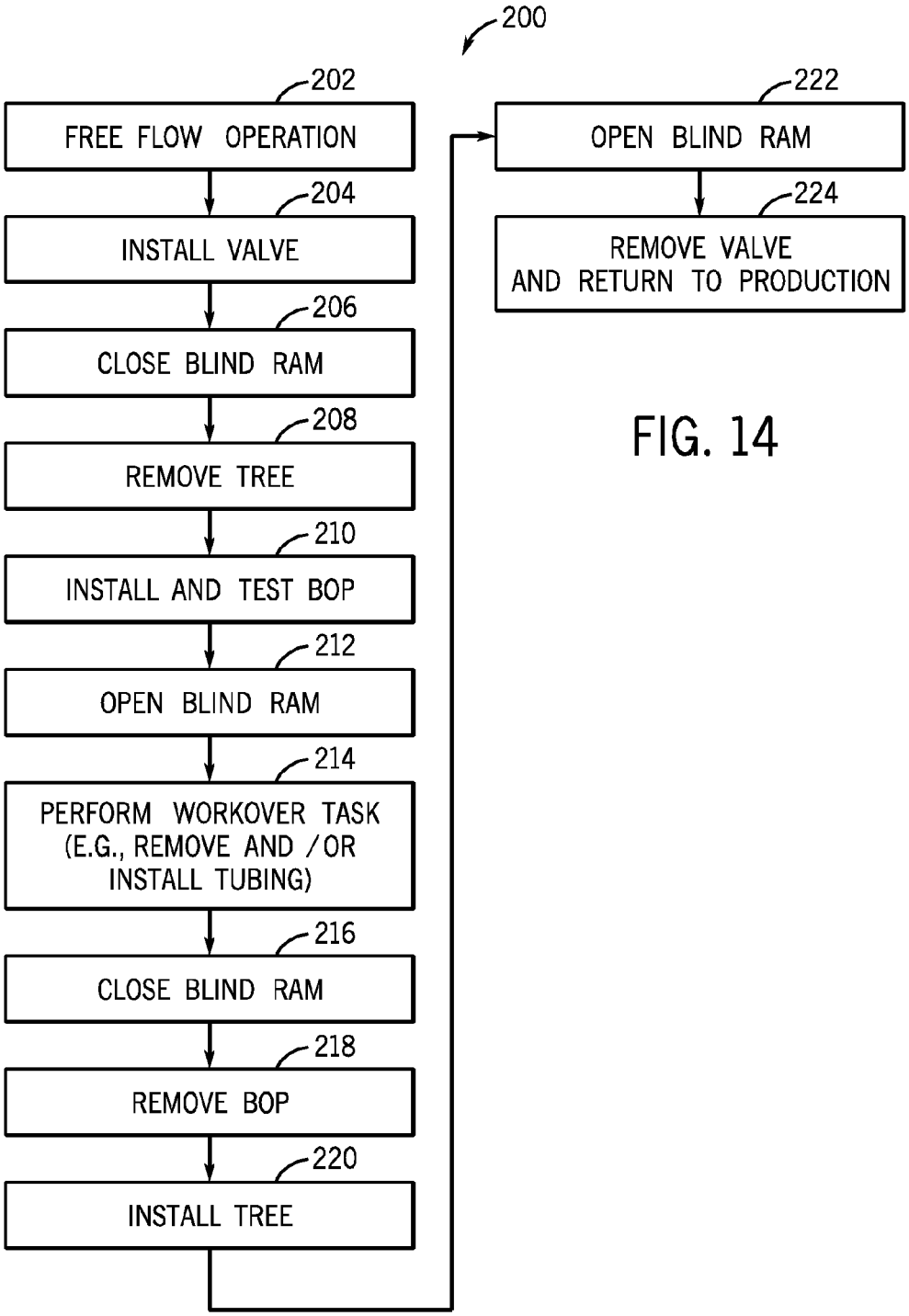
FIGS. 14-16 are flowcharts depicting processes of operations using an integrated wellhead assembly in accordance with embodiments of the present invention.
Figure 15:
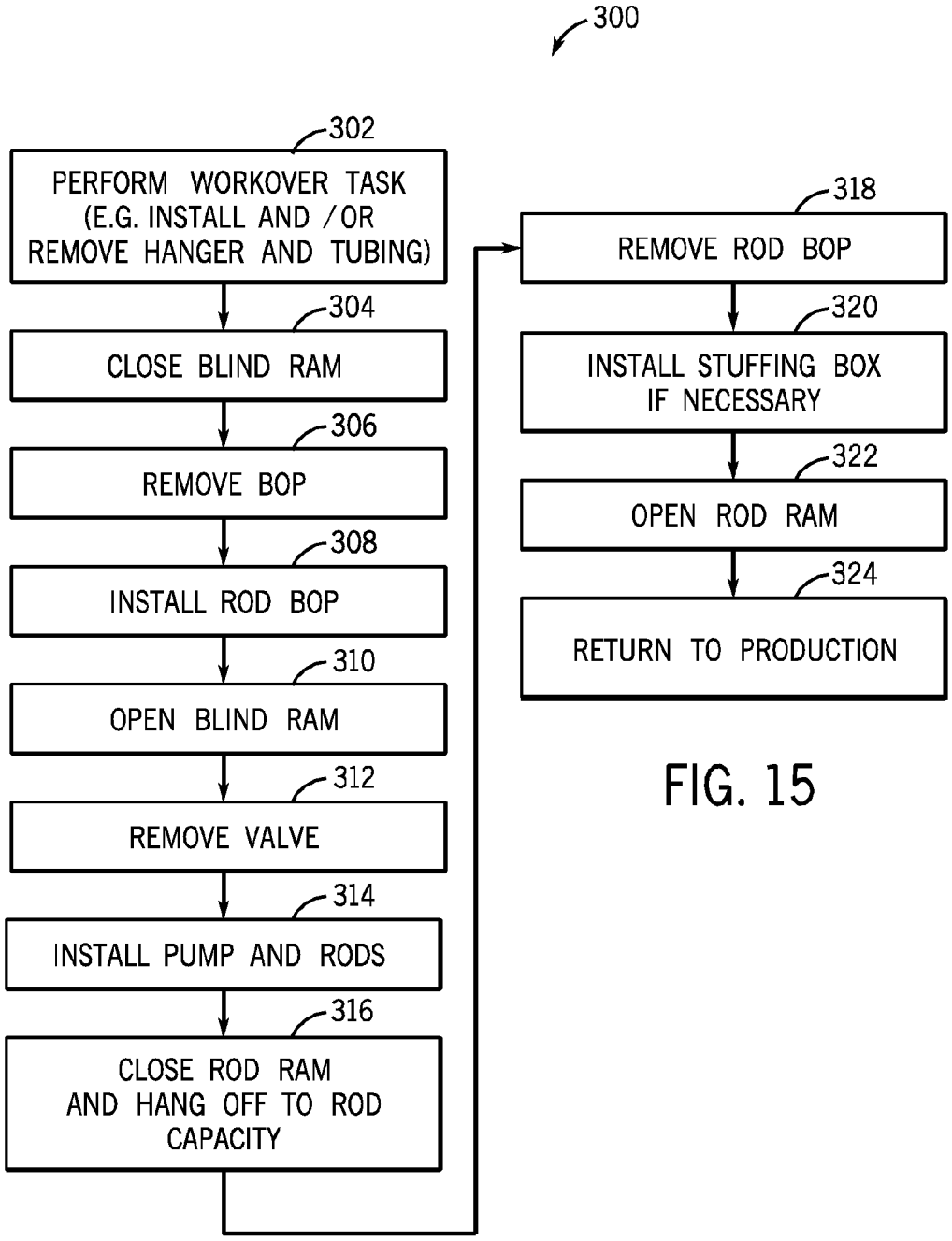
Figure 16:
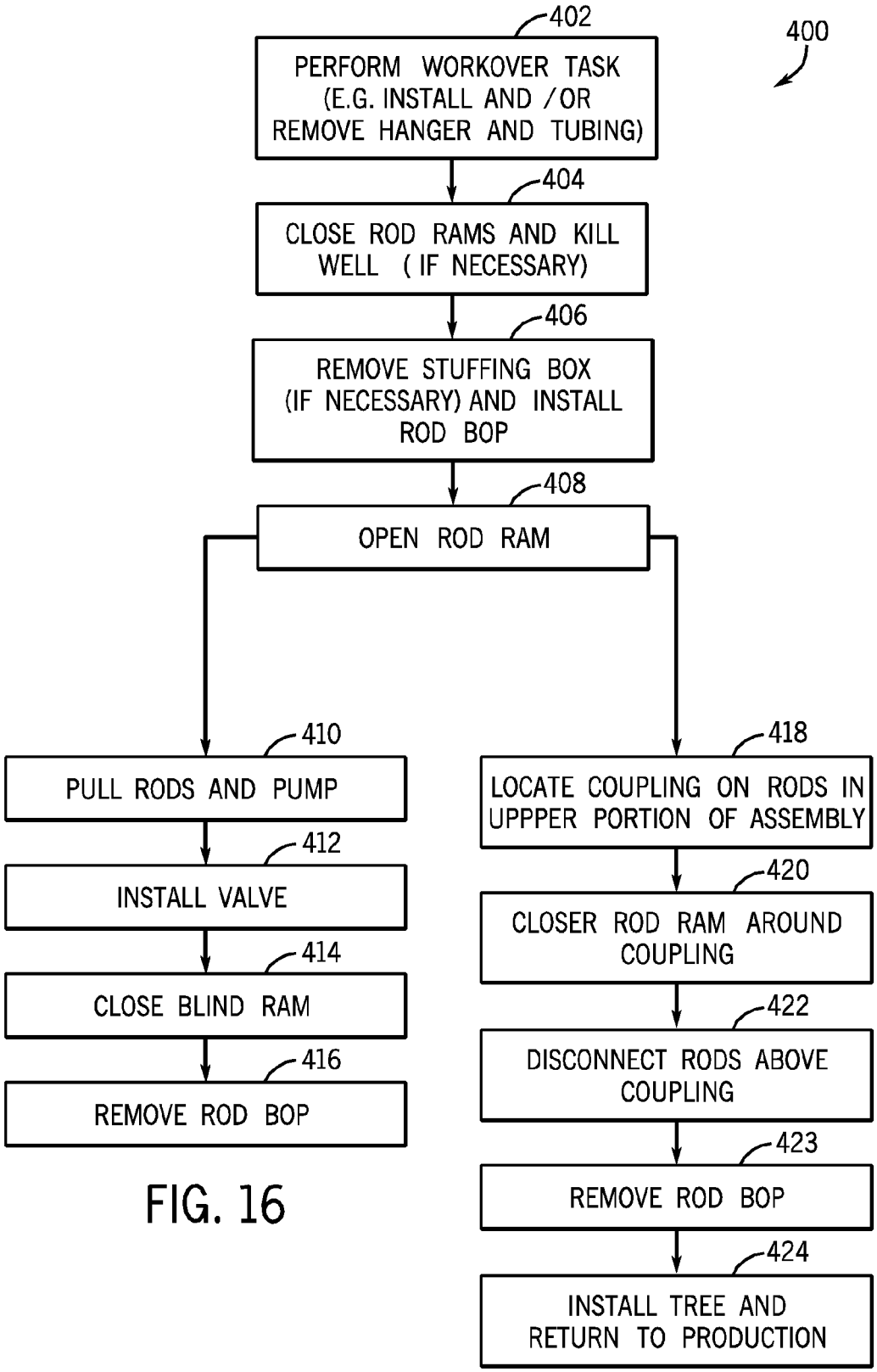

FIGS. 14-16 are flowcharts depicting various operations using the integrated wellhead assembly 12. As illustrated above in FIGS. 2A-2D, such operations may be performed without removal and/or reconfiguration of the wellhead 12. FIG. 14 depicts a process 200 for workover operation for a free flow production well using the integrated wellhead assembly 12 in accordance with an embodiment of the present invention. Initially, the wellhead assembly 12 may be used in free flow production (block 202) and producing mineral through a tree coupled to the wellhead assembly 12 (as depicted in FIG. 2B). To workover the well 16, a valve (e.g., a check valve) may be installed in the wellhead assembly 12 (block 204). The blind rams 34 may be closed to seal the well 16 (block 206). It should be appreciated that the valve and blind rams 34 may provide a dual barrier compliant seal during the workover.

The tree may be removed from the wellhead assembly (block 208), and a BOP (e.g., a tubing BOP) may be installed on the wellhead assembly 12 and tested (block 210). The blind rams 34 may then be opened to provide full bore access to the well 16 (block 212). A workover task may be performed in the well 16 (block 214), such as insertion and use of a tool, removal and/or installation of a hanger and/or tubing, etc. The blind rams 34 may be closed to seal the well (block 216) and provide another barrier during removal of the BOP (block 218). A tree may be installed (block 220) and the blind rams 34 may be opened (block 222). The valve may be removed and the well 16 may then be returned to production (block 224). It should be appreciated that the process 200 may be implemented in an artificial lift system 12 using the wellhead 12, but the rod rams 36 may provide sealing of the well 16 during installation of a rod BOP and/or removal of the rods.

FIG. 15 depicts a process 300 for conversion from free flow production to artificial production using the integrated wellhead assembly 12 in accordance with an embodiment of the present invention. The process 300 may include workover of the free flow well to perform a workover task (block 302), such as depicted in blocks 202-214 of FIG. 14. The workover task may include removal of a hanger and/or tubing adapted for free flow production and installation of a hanger and/or tubing adapted for artificial lift production. Next, the blind rams 36 may be closed (block 304) and the tubing BOP may be removed (block 306). A rod BOP (block 308) may be installed on the wellhead assembly 12 and the blind rams 36 may be opened (block 310). Any valve disposed in the bore of the wellhead assembly 12 may be removed (block 312). The artificial lift pump and rods, e.g., sucker rods, may be installed in the wellhead assembly (block 314).

After installation of the pump and rods, the rod rams 34 may be closed to enable hang off up to the rod capacity (block 316). The rod BOP may then be removed (block 318). A stuffing box may be installed on the wellhead assembly 12 (block 320) or, in other embodiments, the stuffing box may already be integrated with the upper portion of the wellhead assembly 12. The rod rams 34 may be opened (block 322) and production may be resumed through completion of the artificial lift system (block 324).

FIG. 16 depicts a process 400 for conversion from free flow production to artificial lift production using the wellhead assembly 12 in accordance with an embodiment of the present invention. The process 400 may include workover of the artificial lift well to perform a workover task (block 402). The workover task may include removal of a hanger and/or tubing adapted for artificial lift production and installation of a hanger and/or tubing adapted for free flow production. Next, the rod rams may be closed and, in some embodiments, the well may be killed (block 404). In one embodiment, the stuffing box may be removed from the wellhead assembly 12 and a rod BOP installed (block 406). In other embodiments having an integrated stuffing box, as discussed above, the stuffing box may not be removed. After installation of the rod BOP the rod rams may be opened (block 408).

In some embodiments, the well 16 may be converted to free flow production, such as depicted above in FIG. 2B. In such an embodiment, the rods and pump may be removed from the well (block 410). A valve (e.g., a check valve) may be installed in the wellhead assembly 12 (block 412). Additionally, the blind rams 34 may be closed to seal the well 16 (block 414) and provide dual barrier sealing capability with the valve. After closing the blind rams 34, the rod BOP may be removed (block 416). The well 16 may then be converted to free flow production by installing a tubing BOP, removing and/or installing a hanger and/or tubing, and installing a tree, as described in blocks 210-224 of FIG. 14.

In another embodiment, the wellhead assembly 12 may enable hang off of a pump and rod assembly to convert from artificial lift production to free flow production. In such an embodiment, after opening the rod rams (block 408) the pump may be unseated and the rods may be pulled to locate a rod coupling in the upper portion 24 of the wellhead assembly 12 (block 418). After locating the coupling, the rod rams 36 may be closed around the coupling (block 420) to seal the well 16 and the rods above the coupling may be disconnected and removed (block 422). The rod BOP may then be removed (424). A tree may be installed on the integrated wellhead assembly 12 and the free flow production may begin (block 426).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A mineral extraction system, comprising a wellhead assembly having a lower portion and an upper portion, wherein the lower portion and upper portion form a permanently coupled unit, wherein the lower portion comprises:

a support configured to support a hanger; and a flange configured to couple to a wellhead hub;

wherein the upper portion comprises:

a port disposed on the upper portion; and one or more rams configured to seal the bore of the wellhead assembly.

2. The mineral extraction system of claim 1, wherein the upper portion comprises a sealing component.

3. The mineral extraction system of claim 2, wherein the sealing component comprises a stuffing box coupled to the upper portion of the wellhead assembly.

4. The mineral extraction system of claim 3, comprising a drivehead coupled to the stuffing box.

5. The mineral extraction system of claim 3, comprising one or more rods and a pump inserted into the bore of the wellhead assembly, wherein the one or more rods are inserted through an orifice of the stuffing box.

6. The mineral extraction system of claim 1, wherein the upper portion comprises one or more lock screws configured to secure the hanger.

7. The mineral extraction system of claim 1, wherein the lower portion comprises one or more side ports.

8. The mineral extraction system of claim 1, wherein the one or more rams are configured to provide full bore access to the wellhead assembly.

9. The mineral extraction system of claim 1, wherein the one or more rams comprise rod rams configured to seal around a rod inserted into the bore of the wellhead assembly.

10. The mineral extraction system of claim 1, wherein the one or more rams comprise blind rams.

11. The mineral extraction system of claim 1, comprising a tree coupled to the upper portion of the wellhead assembly.

12. The mineral extraction system of claim 1, wherein the wellhead assembly further comprises a tube extending from the lower portion to at least the upper portion and having a tube bore in fluid communication with the bore of the lower portion.

13. The mineral extraction system of claim 12, wherein the tube is adapted to provide for production of minerals from the well through the tube bore.

14. A system, comprising:

a wellhead assembly, comprising:

a lower portion adapted to receive a hanger; and an upper portion permanently fixed to the lower portion, wherein the upper portion is adapted to seal the bore of the wellhead assembly in a first position, and the upper portion is adapted to provide full bore access to the wellhead assembly in a second position.

15. The system of claim 14, wherein the upper portion comprises at least one set of rams.

16. The system of claim 14, wherein the upper portion comprises an annular blowout preventer.

17. The system of claim 14, wherein the upper portion comprises a backpressure valve head.

18. The system of claim 14, wherein the upper portion is adapted to receive a drivehead of an artificial lift system.

19. The system of claim 18, wherein the upper portion comprises a stuffing box configured to couple to the drivehead.

20. The system of claim 14, wherein the upper portion comprises a composite pumping tee head.

21. A mineral extraction system, comprising:

a one-piece wellhead, comprising:

a free flow production component configured to provide a free flow of a mineral through the one-piece wellhead; and an artificial flow production component configured to provide an artificial flow of the mineral through the one-piece wellhead, wherein the one-piece wellhead integrates the free flow production component and the artificial flow production component to selectively provide both the free flow and the artificial flow without removal of the one-piece wellhead.

22. The mineral extraction system of claim 21, wherein the one-piece wellhead comprises at least one set of rams in a first portion and a shoulder in a second portion configured to receive a hanger.

23. The mineral extraction system of claim 21, wherein the one-piece wellhead comprises a first portion configured to seal around a rod of an artificial lift system in artificial production and provide full bore access in free flow production.

24. The mineral extraction system of claim 21, wherein the one-piece wellhead comprises a first portion configured to receive a stuffing box, a tree, and a BOP.

* * * * *